US010164336B2

(12) United States Patent
Nakano

(10) Patent No.: US 10,164,336 B2
(45) Date of Patent: Dec. 25, 2018

(54) ANTENNA DEVICE AND ELECTRONIC APPARATUS

(71) Applicant: Murata Manufacturing Co., Ltd., Nagaokakyo-shi, Kyoto-fu (JP)

(72) Inventor: Shinichi Nakano, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 260 days.

(21) Appl. No.: 15/353,795

(22) Filed: Nov. 17, 2016

(65) Prior Publication Data

US 2017/0194711 A1 Jul. 6, 2017

Related U.S. Application Data

(63) Continuation of application No. PCT/JP2015/065184, filed on May 27, 2015.

(30) Foreign Application Priority Data

May 30, 2014 (JP) ..... 2014-111837

(51) Int. Cl.
*H01Q 7/08* (2006.01)
*H01Q 7/06* (2006.01)
(Continued)

(52) U.S. Cl.
CPC ..... *H01Q 7/06* (2013.01); *H01Q 1/2216* (2013.01); *H01Q 1/2225* (2013.01);
(Continued)

(58) Field of Classification Search
None
See application file for complete search history.

(56) References Cited

U.S. PATENT DOCUMENTS 8,059,062 B2 * 11/2011 Orihara ..... G06K 19/07749 343/872
8,378,911 B2 * 2/2013 Eray ..... G06K 19/07749 343/788
(Continued)

FOREIGN PATENT DOCUMENTS

JP 11-3411 A 1/1999
JP 2007-324865 A 12/2007
(Continued)

OTHER PUBLICATIONS

Official Communication issued in corresponding International Application PCT/JP2015/065184, dated Jul. 7, 2015.

*Primary Examiner* — Trinh Dinh
(74) *Attorney, Agent, or Firm* — Keating & Bennett, LLP

(57) ABSTRACT

An antenna device includes a planar coil, a planar conductor, a first power feed terminal, and a second power feed terminal. The planar conductor includes a cutout opposed to the planar coil that overlaps with a coil aperture. The planar coil includes a first conductor pattern portion and a second conductor pattern portion. The first power feed terminal is connected to a first end of the first conductor pattern portion and the second power feed terminal is connected to a first end of the second conductor pattern portion on a side adjacent to or in a vicinity of the first end of the first conductor pattern portion. Second ends of the first conductor pattern portion and the second conductor pattern portion are connected to the planar conductor.

16 Claims, 18 Drawing Sheets

(51) Int. Cl.

| | |
|---|---|
| ***H01Q 7/00*** | (2006.01) |
| ***H01Q 1/22*** | (2006.01) |
| ***H01Q 1/24*** | (2006.01) |
| *H01F 17/00* | (2006.01) |

(52) U.S. Cl.
CPC ..... *H01Q 1/242* (2013.01); *H01Q 7/00* (2013.01); *H01F 17/0006* (2013.01)

(56) References Cited

U.S. PATENT DOCUMENTS

| | | | | |
|---|---|---|---|---|
| 8,792,837 | B2 * | 7/2014 | Deguchi | G06K 7/10336 343/788 |
| 9,595,749 | B2 * | 3/2017 | Yosui | H01Q 1/2208 |
| 2009/0201116 | A1 | 8/2009 | Orihara | |
| 2013/0207852 | A1 | 8/2013 | Nakano | |
| 2013/0229319 | A1 | 9/2013 | Miura et al. | |
| 2014/0203991 | A1 * | 7/2014 | Yosui | G06K 19/07783 343/866 |
| 2017/0033435 | A1 * | 2/2017 | Nakano | H01Q 1/24 |

FOREIGN PATENT DOCUMENTS

| | | | |
|---|---|---|---|
| JP | 2013-055637 | A | 3/2013 |
| JP | 2013-168894 | A | 8/2013 |
| JP | 2014-011533 | A | 1/2014 |
| WO | 2012/111430 | A1 | 8/2012 |

* cited by examiner

| | | Model 1 | Model 2 | Model 3 | Spec |
|---|---|---|---|---|---|
| Card Mode | ACR | 35 | 38 | 45 | 25mm |
| RW Mode | Type 1 (Topaz) | 35 | 42 | 44 | 20mm |
| | Type 2 (Mifare UL) | 32 | 38 | 38 | 30mm |
| | Type 4A (DESFire) | 8 | 14 | 15 | 15mm |

ANTENNA DEVICE AND ELECTRONIC APPARATUS

CROSS REFERENCE TO RELATED APPLICATIONS

This application claims the benefit of priority to Japanese Patent Application No. 2014-111837 filed on May 30, 2014 and is a Continuation Application of PCT/JP2015/065184 filed on May 27, 2015. The entire contents of each application are hereby incorporated by reference.

BACKGROUND OF THE INVENTION

1. Field of the Invention

The present invention relates to an antenna device preferably for use in, for example, HF-band communication, and relates to an electronic apparatus including the antenna device.

2. Description of the Related Art

A planar coil antenna has been used as an antenna device for an RFID (radio frequency identifier) or NFC (near field communication). In general, the planar coil antenna includes a base material and a rectangular spiral conductor pattern provided on the base material.

Japanese Unexamined Patent Application Publication No. 11-3411 discloses an antenna device in which the inductance of such a planar coil antenna can be adjusted and set to a predetermined value. In the antenna device of Japanese Unexamined Patent Application Publication No. 11-3411, a conductor pattern is provided on each surface of a base material, an antenna coil having a plurality of turns is provided on a front surface of the base material, and a one-turn coil partly opened is provided on a back surface of the base material to have almost the same shape as that of a region defined by the outermost periphery and the innermost periphery of the antenna coil.

When an antenna device is included in an electronic apparatus such as a mobile communication terminal, it is required to obtain a predetermined gain with a more compact size along with recent reduction in size and thickness of electronic apparatuses.

In the antenna device disclosed in Japanese Unexamined Patent Application Publication No. 11-3411, an equivalent inductance of the antenna coil is determined within a certain range by the capacitance generated between the antenna coil and the one-turn coil, but the one-turn coil does not function as a radiation element in itself. That is, the current generated in the one-turn coil is only an induced current generated by magnetic coupling to the antenna coil on the front surface, and this induced current is not large. For this reason, a magnetic field generated by the induced current is also not large, and it is difficult to use the one-turn coil as a radiation element.

Further, in a case in which some conductor pattern is provided on the back surface of the base material, as in the antenna device of Japanese Unexamined Patent Application Publication No. 11-3411, when a power feed circuit, such as an RFIC, is coupled to an inner peripheral end and an outer peripheral end of the rectangular spiral conductor pattern provided on the base material, a line for connecting the inner peripheral end and the power feed circuit needs to be formed on the surface where the rectangular spiral conductor pattern is provided and in a state insulated from the rectangular spiral conductor pattern. For this reason, the structure and formation method of the conductor pattern are complicated. Further, the line for connecting the inner peripheral end of the rectangular spiral conductor pattern and the power feed circuit, for example, a jumper line, causes deterioration of antenna characteristics.

SUMMARY OF THE INVENTION

Preferred embodiments of the present invention provide a compact antenna device that achieves high gain. Preferred embodiments of the present invention also provide an antenna device and an electronic apparatus that reduces production cost by simplifying a structure that connects a planar coil and a power feed terminal.

An antenna device according to a preferred embodiment of the present invention includes a planar coil including a conductor wound around a coil aperture, the planar coil having a planar or a substantially planar shape, a planar conductor opposed to the planar coil and including a cutout that at least partially overlaps with the coil aperture, and a first power feed terminal and a second power feed terminal located in an outer side portion of a region including the planar coil or an inner side portion of the coil aperture in plan view. The planar coil includes a first conductor pattern portion and a second conductor pattern portion that extend along an outer periphery or an inner periphery of the first conductor pattern portion or that overlap with the first conductor pattern portion in plan view. The first power feed terminal is conductively connected to a first end of the first conductor pattern portion, and the second power feed terminal is conductively connected to a first end of the second conductor pattern portion on a side adjacent to or in a vicinity of the first end of the first conductor pattern portion. Second ends of the first conductor pattern portion and the second conductor pattern portion are connected to the planar conductor.

According to the structure of the antenna device as described above, it is not necessary to include a jumper line or the like that crosses the conductor patterns included in the planar coil, and the overall structure is simplified. Deterioration of the antenna characteristics due to the jumper line or the like is significantly reduced or prevented.

Preferably, the cutout includes a conductor aperture and a slit that connects a portion of the conductor aperture to an outer edge of the planar conductor such that the conductor aperture at least partially overlaps with the coil aperture. According to this structure, the coil aperture and the conductor aperture are close enough to each other over a long periphery that current is efficiently induced in the planar conductor.

Preferably, the second ends of the first conductor pattern portion and the second conductor pattern portion are connected to the planar conductor and do not cross the slit. Thus, the current flowing through the planar conductor is not divided into a current flowing through the planar conductor via the slit and a current flowing through the planar coil via an interlayer connection conductor and a large current flows on a surface of the planar conductor that is not opposed to the planar coil. Therefore, the planar conductor is highly effective as the antenna.

Preferably, the second ends of the first conductor pattern portion and the second conductor pattern portion may be connected to the planar conductor and cross the slit.

The planar coil is preferably wound around the coil aperture in a plurality of turns, for example. This structure increases coupling between the planar coil and the planar conductor, and improves the operation of the planar conductor as a radiation member.

A magnetic sheet preferably covers at least a portion of the planar coil. Since a planar coil with a sufficient inductance is provided by a conductor pattern with a small number of turns, the coil aperture is able to be relatively large. As a result, the degree of coupling to a communication partner side antenna is able to be increased.

An electronic apparatus according to a preferred embodiment of the present invention includes an antenna device and a casing. The antenna device includes a planar coil including a conductor wound around a coil aperture, the planar coil having a planar or a substantially planar shape, a planar conductor opposed to the planar coil and including a cutout that at least partially overlaps with the coil aperture, and a first power feed terminal and a second power feed terminal located in an outer side portion of a region including the planar coil or an inner side portion of the coil aperture in plan view. The planar coil includes a first conductor pattern portion and a second conductor pattern portion that extend along an outer periphery or an inner periphery of the first conductor pattern portion or that overlap with the first conductor pattern portion in plan view. The first power feed terminal is conductively connected to a first end of the first conductor pattern portion, and the second power feed terminal is conductively connected to a first end of the second conductor pattern portion on a side adjacent to or in the vicinity of the first end of the first conductor pattern portion. Second ends of the first conductor pattern portion and the second conductor pattern portion are connected to the planar conductor.

According to the structure of the antenna device as described above, it is not necessary to include a jumper line or the like that crosses the conductor patterns included in the planar coil, and the overall structure is simplified. Deterioration of the antenna characteristics due to the jumper line or the like is significantly reduced or prevented.

Preferably, the casing includes a conductor portion, and the conductor portion defines the planar conductor. Thus, because the conductor portion of the casing is also able to provide the planar conductor, it is not necessary to include a special exclusive planar conductor, and size and cost are able to be reduced. In addition, because the planar conductor is located on the outer surface of the electronic apparatus or at a position adjacent to or in a vicinity of the outer surface, the planar conductor is able to be easily located closer to a communication partner side antenna, and communication performance is able to be easily enhanced.

According to various preferred embodiments of the present invention, it is not necessary to include a jumper line or the like that crosses the conductor patterns included in the planar coil, and the overall structure is simplified. Also, deterioration of the antenna characteristics due to the jumper line or the like is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
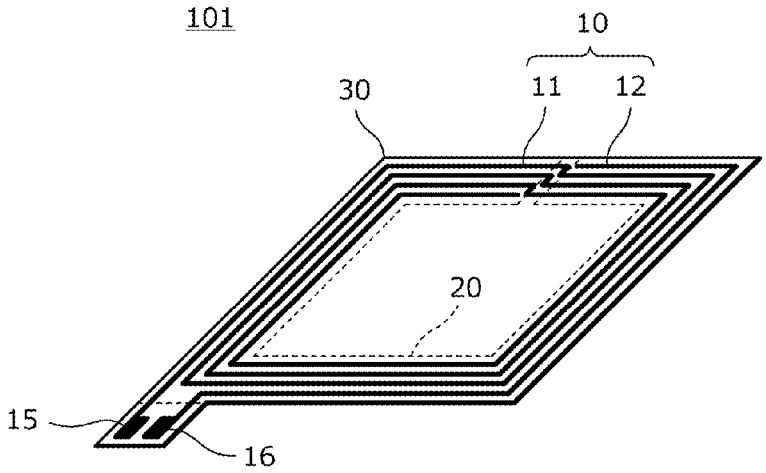
FIG. 1 is a perspective view of an antenna device according to a first preferred embodiment of the present invention.
Figure 2:
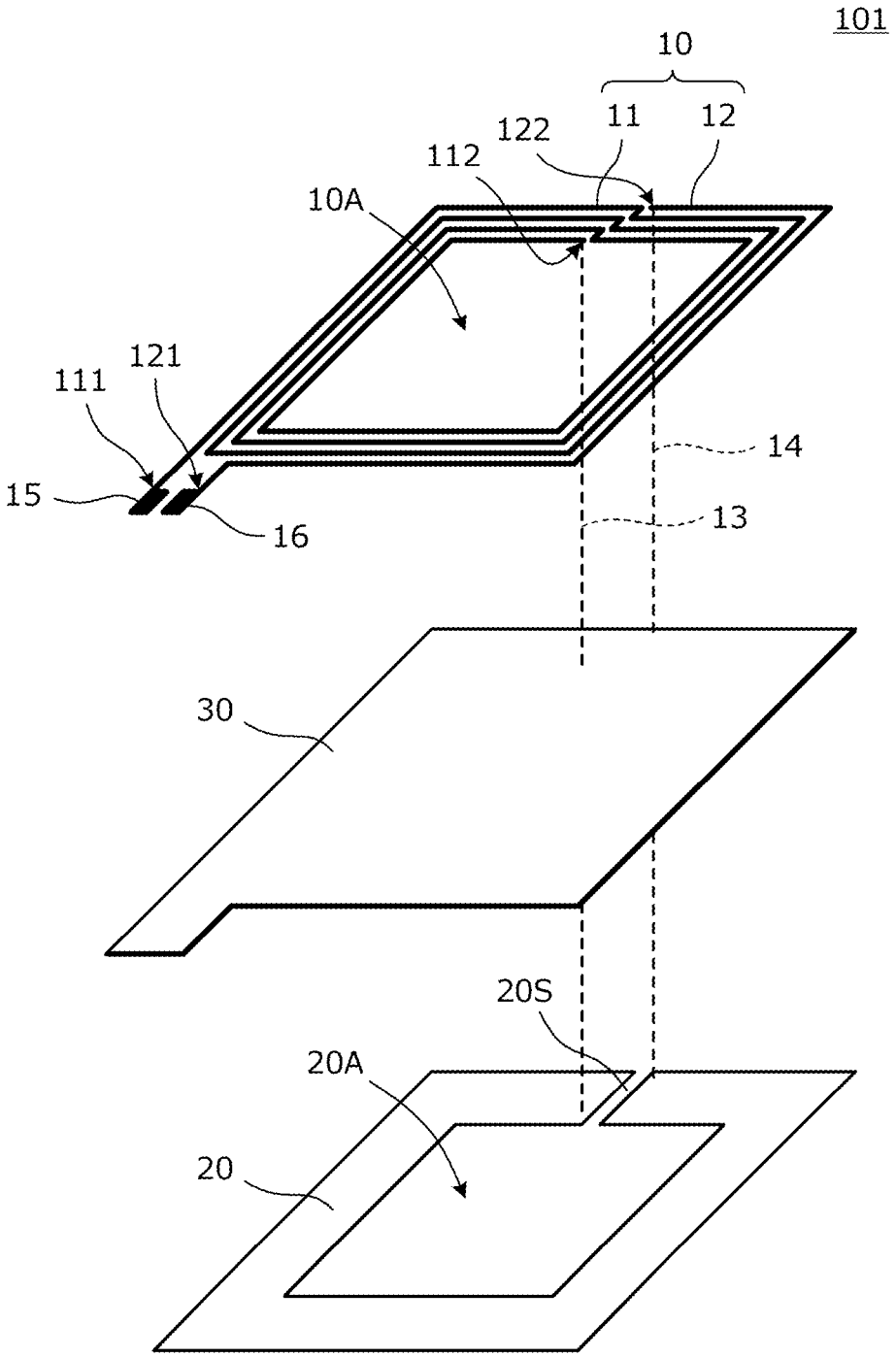
FIG. 2 is an exploded perspective view of the antenna device according to the first preferred embodiment of the present invention.

FIG. 1 is a perspective view of an antenna device 101 according to a first preferred embodiment of the present invention, and FIG. 2 is an exploded perspective view of the antenna device 101.

The antenna device 101 includes a planar coil 10, a planar conductor 20 opposed to the planar coil 10 with an insulating layer 30 interposed therebetween, a first power feed terminal 15, and a second power feed terminal 16. The planar coil 10 includes a first conductor pattern portion 11 and a second conductor pattern portion 12 wound around a coil aperture 10A along a surface of the insulating layer 30. The planar conductor 20 includes a cutout defined by a conductor aperture 20A overlapping with the coil aperture 10A and a slit 20S that connects a portion of the conductor aperture 20A to an outer edge. The planar conductor 20 is substantially C-shaped in plan view. The first power feed terminal 15 and the second power feed terminal 16 are located in an outer side portion of a region including the conductor patterns 11 and 12 in plan view.

The planar conductor 20 and the planar coil 10 are equal or substantially equal in outer size. Also, the size of the principal portion of the insulating layer 30 is equal or substantially equal to the outer sizes of the planar conductor 20 and the planar coil 10. Thus, the antenna device is able to be compact as a whole, even though it includes the planar conductor 20.

The first conductor pattern portion 11 preferably has a rectangular or substantially rectangular spiral shape, and the second conductor pattern portion 12 extends along the outer periphery of the first conductor pattern portion 11. The first power feed terminal 15 is conductively connected to a first end 111 of the first conductor pattern portion 11, and the second power feed terminal 16 is conductively connected to a first end 121 of the second conductor pattern portion 12, that is, an end adjacent to or in a vicinity of the first end 111 of the first conductor pattern portion 11.

A second end 112 of the first conductor pattern portion 11 is connected to the planar conductor 20 with a first interlayer connection conductor 13 interposed therebetween. A second end 122 of the second conductor pattern portion 12 is connected to the planar conductor 20 with a second interlayer connection conductor 14 interposed therebetween. The second ends of the first conductor pattern portion 11 and the second conductor pattern portion 12 are connected to the planar conductor 20 to cross the slit 20S. That is, the second ends 112 and 122 of the first conductor pattern portion 11 and the second conductor pattern portion 12 are connected to both end portions of the substantially C-shaped planar conductor 20 between which the slit 20S is provided. In more detail, the second end 112 of the first conductor pattern portion 11 is connected to an end portion, located on a side where the first conductor pattern portion 11 extends from the second end 112, of both end portions of the planar conductor 20 located with the slit 20S interposed therebetween. The second end 122 of the second conductor pattern portion 12 is connected to an end portion located on a side where the second conductor pattern portion 12 extends from the second end 122, of the end portions of the planar conductor 20 located with the slit 20S interposed therebetween.

A non-limiting example of a manufacturing method for the antenna device 101 is described below. First, for example, holes are formed at positions where interlayer connection conductors are to be formed on a flexible board obtained by laminating copper foil on one surface of a PET film, the copper coil is patterned, and conductive paste is embedded in the holes, to form a planar coil 10, power feed terminals 15 and 16, and interlayer connection conductors 13 and 14. Further, a planar conductor 20 is formed by punching the copper foil. Then, the planar conductor 20 is bonded to the flexible board including the planar coil 10 to provide an antenna device 101. Since it is only necessary to define a conductive pattern on one surface of a base material sheet, the manufacturing method described above achieves a reduction in cost.

Alternatively, a planar coil 10 and power feed terminals 15 and 16 may be formed on a flexible board having copper foil on both surfaces by patterning the copper foil on a first surface of the flexible board, a planar conductor 20 may be formed by patterning the copper foil on a second surface of the flexible board, and interlayer connection conductors 13 and 14 may be formed by via holes.

As described above, according to the first preferred embodiment, a jumper line that crosses the conductor patterns included in the planar coil is unnecessary, thus simplifying and facilitating manufacturing.

The antenna device 101 operates as described below. For example, if the antenna device 101 operates as a transmitting antenna, when a current flows through the planar coil 10, a current in a direction opposite from the current direction of the planar coil 10 is induced on the first surface of the planar conductor 20, that is, a surface opposed to the planar coil. The current flows through the planar coil 10 via the interlayer connection conductors 13 and 14 and the planar conductor 20. This current flows through the planar conductor similar to a one-turn coil. That is, the current flows in a direction opposite from the direction of current flowing through the planar coil 10. The current induced on the planar conductor is turned back onto the second surface of the planar conductor 20 adjacent to or in the vicinity of the slit 20S. Since the direction of the current flowing on the second surface of the planar conductor 20 is the same as the direction of the current flowing through the planar coil, the planar conductor 20 operates as an antenna together with the planar coil 10. The antenna device 101 similarly operates as a receiving antenna according to the reciprocal theorem of the antenna.

Figure 3:
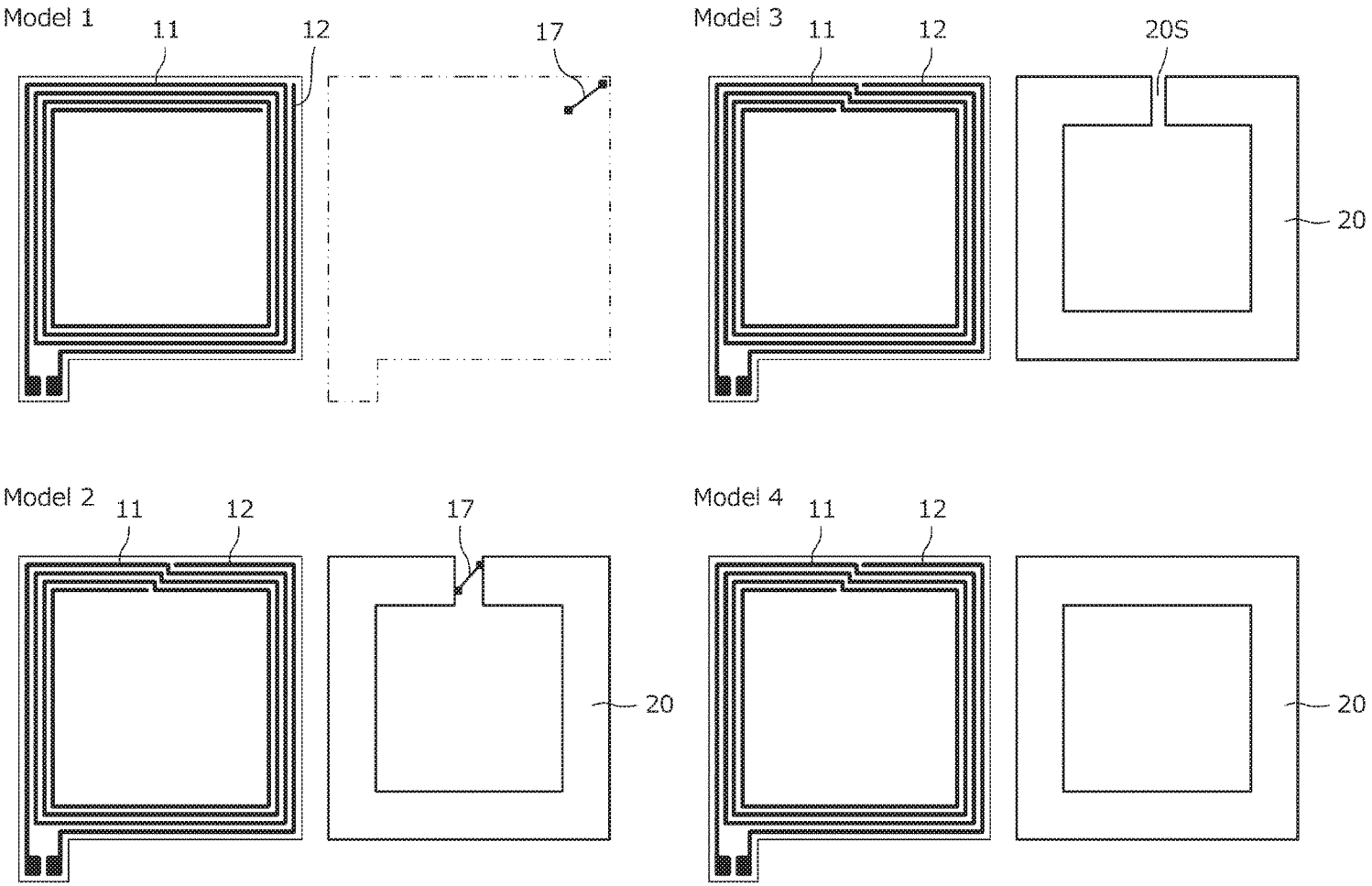
FIG. 3 shows plan views of models to simulate characteristics of the antenna device of the first preferred embodiment of the present invention and antenna devices of comparative examples.

FIG. 3 shows plan views of models to simulate the characteristics of the antenna device of the first preferred embodiment of the present invention and antenna devices of comparative examples. Each of Models 1 to 4 is shown in a plan view of a first conductor pattern portion 11 and a second conductor pattern portion 12 provided on an upper surface of an insulating layer and a plan view of a planar conductor 20 provided on a lower surface of the insulating layer. However, the planar conductor 20 in each plan view is viewed from the upper surface, that is, from the side where the first conductor pattern portion 11 and the second conductor pattern portion 12 are provided.

Referring to FIG. 3, an antenna device of Model 1 does not include a planar conductor, and a simple planar coil having a rectangular or substantially rectangular spiral shape is defined by a first conductor pattern portion 11, a second conductor pattern portion 12, and a connection conductor pattern 17. An antenna device of Model 2 includes a planar conductor 20, and a planar coil having a rectangular or substantially rectangular spiral shape is defined by a first conductor pattern portion 11, a second conductor pattern portion 12, and a connection conductor pattern 17. An antenna device of Model 3 corresponds to the antenna device 101 of the first preferred embodiment. An antenna device of Model 4 includes a planar conductor 20, and a planar coil preferably having a rectangular or substantially rectangular spiral shape is defined by a first conductor pattern portion 11, a second conductor pattern portion 12, and a portion of the planar conductor 20. The antenna of Model 4 does not include a slit 20S, unlike the antenna device 101 of the first preferred embodiment. In each of Models 1 to 4, the outer dimensions of the planar coil are about 30×30 mm, and the dimensions of the coil aperture are about 22×22 mm, for example.

Figure 4:
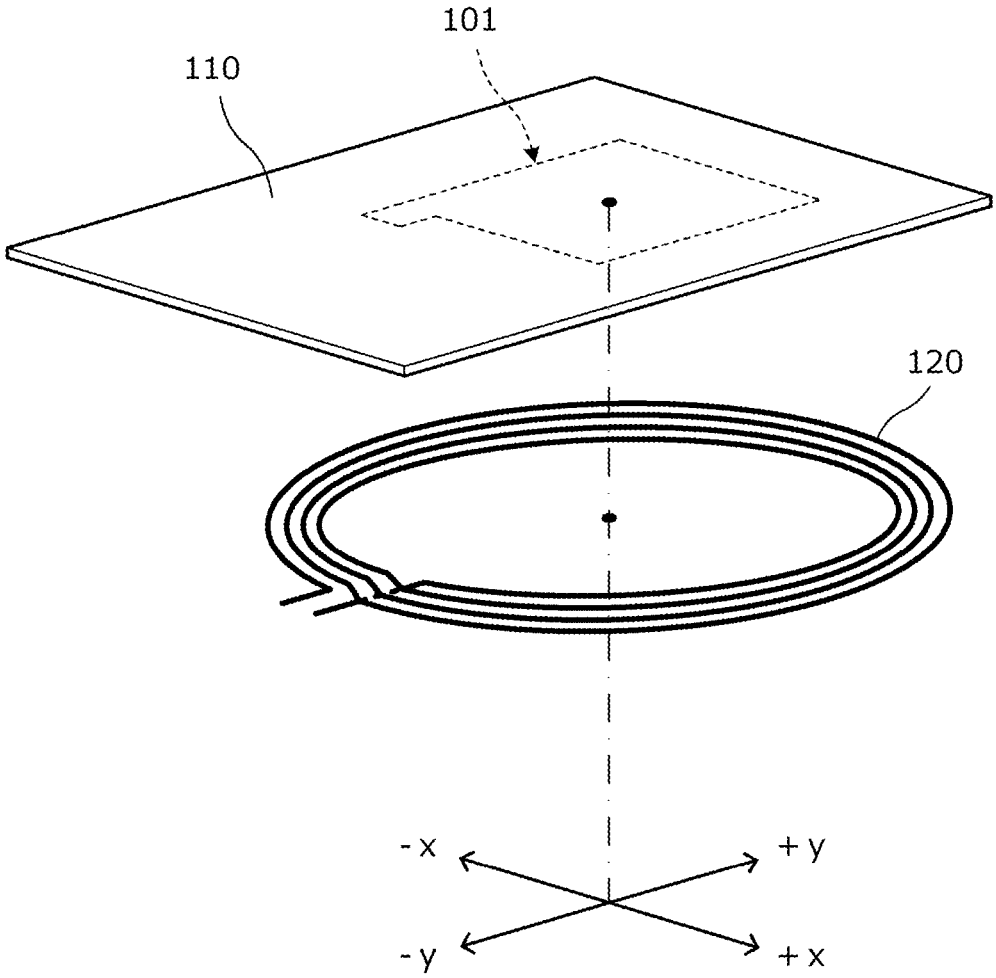
FIG. 4 shows an arrangement between the antenna devices shown in FIG. 3 and a reader/writer side antenna coil operating as a communication partner.

FIG. 4 shows an arrangement between each of the antenna devices shown in FIG. 3 and a reader/writer side antenna coil operating as a communication partner. As shown in FIG. 4, the antenna device to be evaluated is located on a lower surface of a circuit board 130. The reader/writer side antenna coil 120 preferably has an outer diameter of about 150 mm and an inner diameter of about 100 mm, for example.

Figure 5:
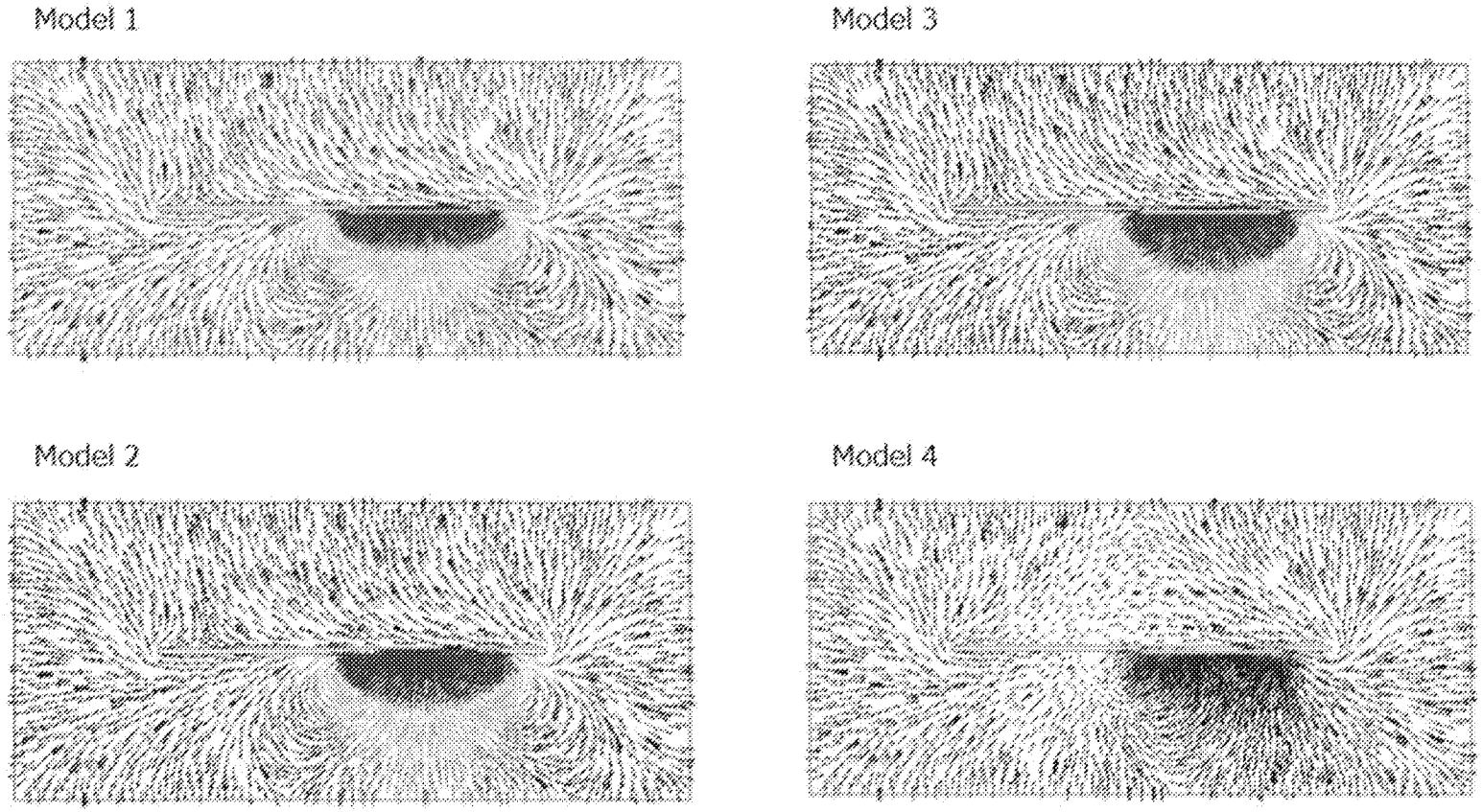
FIG. 5 shows the magnetic-field intensities around the antenna devices of Models 1 to 4.

FIG. 5 shows the magnetic field intensities around the antenna devices of Models 1 to 4. It is shown in FIG. 5 that the magnetic field intensity decreases in the order of Model 3, Model 2, Model 1, and Model 4. Although an induced current is generated in the planar conductor 20 by magnetic field coupling of the planar conductor 20 to the planar coil 10, since the planar conductor 20 includes the slit 20S that connects a portion of the conductor aperture 20A to the outer edge, an eddy current is reduced and the induced current flowing through the planar conductor 20 contributes as an antenna together with the current of the planar coil 10.

Figures 6, 7:
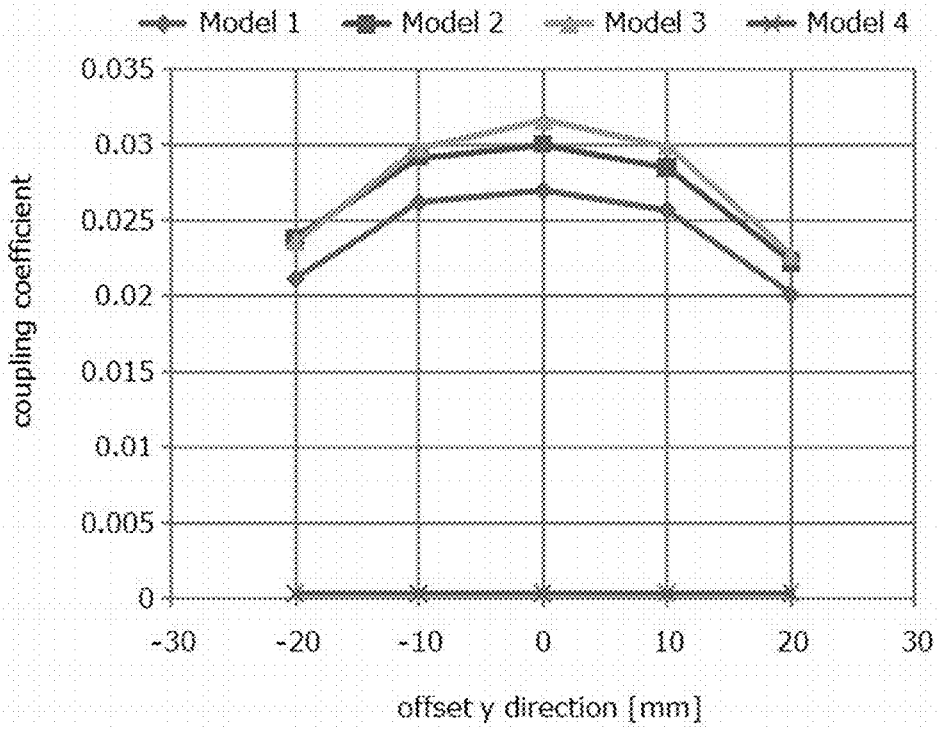
FIG. 6 shows the coupling coefficients of the antenna devices of Models 1 to 4 and the reader/writer side antenna coil.
FIG. 7 shows approximate communication distances of Models 1, 2, and 3 and minimum communication distances specified by NFC standards.

FIG. 6 shows the coupling coefficients between the antenna devices of Models 1 to 4 and the reader/writer side antenna coil 120. The horizontal axis represents the offset amount between the center of each of the antenna devices of Models 1 to 4 and the center of the reader/writer side antenna coil 120, and the vertical axis represents the coupling coefficient. As shown in FIG. 6, Model 4 is not coupled to the antenna coil 120 at all, but Models 1, 2, and 3 are coupled to the antenna coil 120. Among the Models 1, 2, and 3, the coupling coefficient of Model 3, which corresponds to the antenna device 101 of the first preferred embodiment, is the highest.

FIG. 7 shows approximate communication distances of Models 1, 2, and 3 and the minimum communication distances specified by the NFC standards. For example, the NFC standards require a minimum communication distance of 25 mm in the card mode standard ACR and a minimum communication distance of 15 mm in one reader/writer mode standard Type4A (DESFire). Model 3, which corresponds to the antenna device 101 of the first preferred embodiment, satisfies all of the standards, as shown in FIG. 7.

Second Preferred Embodiment

Figure 8:
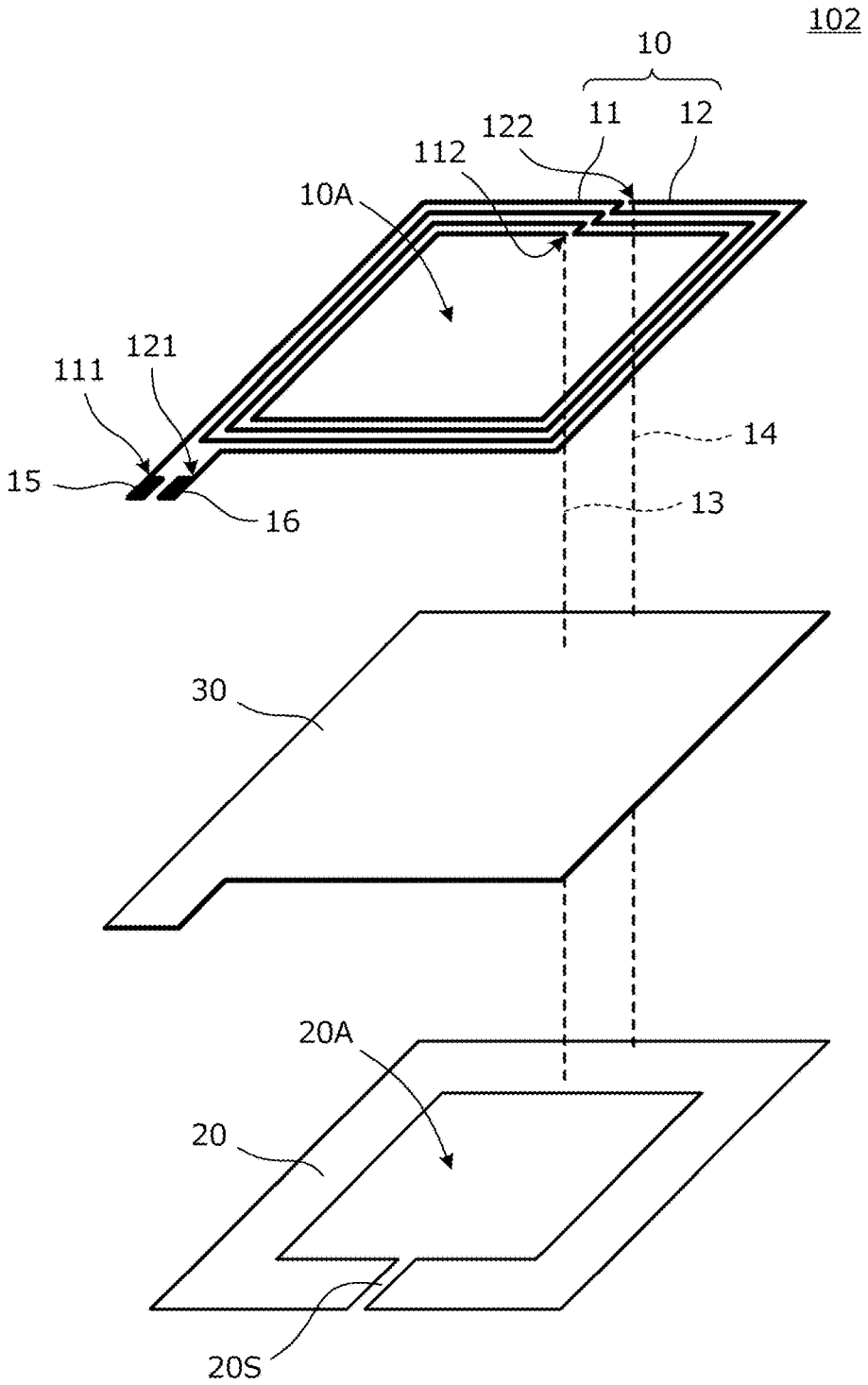
FIG. 8 is an exploded perspective view of an antenna device according to a second preferred embodiment of the present invention.

FIG. 8 is an exploded perspective view of an antenna device 102 according to a second preferred embodiment of the present invention. The antenna device 102 includes a planar coil 10, a planar conductor 20 opposed to the planar coil 10 with an insulating layer 30 interposed therebetween, a first power feed terminal 15, and a second power feed terminal 16. The planar coil 10 includes a first conductor pattern portion 11 and a second conductor pattern portion 12 wound around a coil aperture 10A along a surface of the insulating layer 30. The planar conductor 20 includes a conductor aperture 20A that overlaps with the coil aperture 10A and a slit 20S that connects a portion of the conductor aperture 20A to an outer edge. The first power feed terminal 15 and the second power feed terminal 16 are located in an outer side portion of a region including the conductor pattern portions 11 and 12 in plan view.

The antenna device 102 of the second preferred embodiment and the antenna device 101 of the first preferred embodiment shown in FIG. 2 are different in the positional relationship between the planar coil 10 and the planar conductor 20. In the second preferred embodiment, second ends of the first conductor pattern portion 11 and the second conductor pattern portion 12 are connected to the planar conductor 20 so as not to cross the slit 20S.

The antenna device 102 operates as described below. First, when a current flows through the planar coil 10, a current in a direction opposite from the current direction of the planar coil 10 is induced on the first surface of the planar conductor 20, that is, a surface opposed to the planar coil. The current flows through the planar coil 10 via interlayer connection conductors 13 and 14 and the planar conductor 20. The current induced in the planar conductor 20 flows via the slit 20S and is turned back onto the second surface of the planar conductor 20. Since the direction of the current flowing on the second surface of the planar conductor 20 is the same as the direction of the current flowing through the planar coil, the planar conductor 20 operates as an antenna together with the planar coil 10.

In the antenna device 101 of the first preferred embodiment, the current flowing through the planar conductor 20 is divided into a current flowing to the planar conductor 20 via the slit 20S, that is, to the surface that is not opposed to the planar coil 10, and a current flowing to the planar coil 10 via the interlayer connection conductors 13 and 14. However, since the current is not divided in the antenna device 102 of the second preferred embodiment, a large current flows on the surface of the planar conductor 20 that is not opposed to the planar coil 10. Accordingly, the planar conductor 20 is highly effective as the antenna.

In the antenna device 101 of the first preferred embodiment, since the current concentrates at the slit 20S, conductor loss is relatively large at the slit 20S. In contrast, in the antenna device 102 of the second preferred embodiment, since current concentration at the slit 20S is significantly reduced or prevented, conductor loss is able to be reduced.

Figure 9:
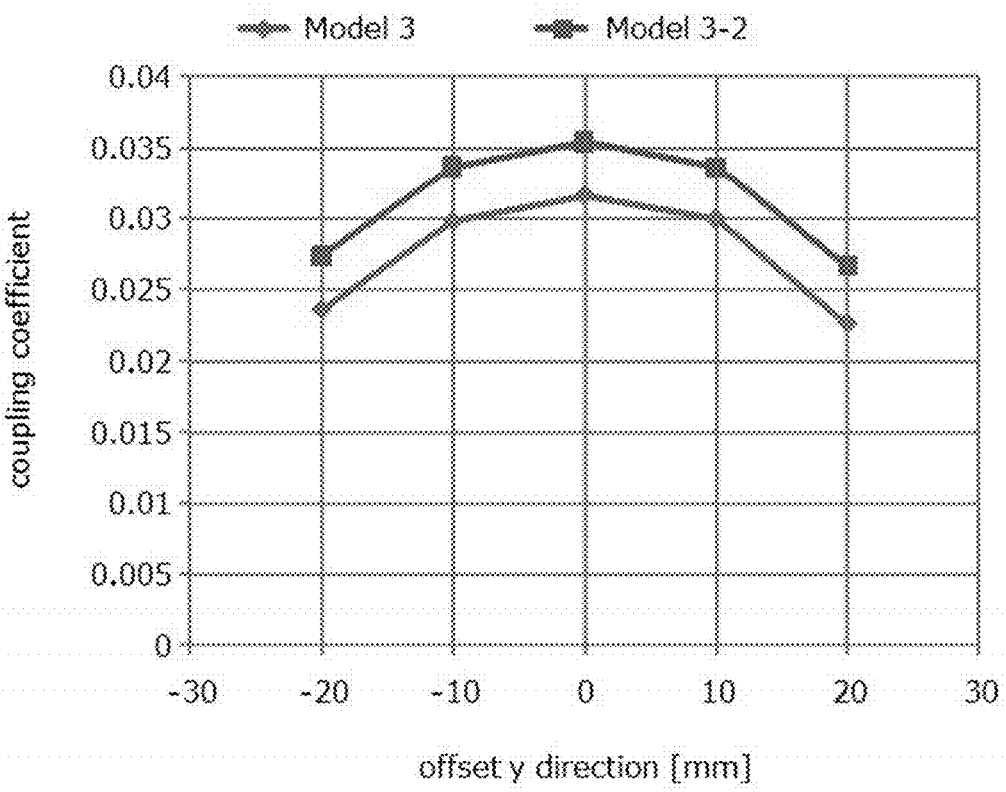
FIG. 9 shows the coupling coefficients between the antenna device of the second preferred embodiment of the present invention and the antenna device of the first preferred embodiment of the present invention, and the reader/writer side antenna coil.

FIG. 9 shows the coupling coefficients of Model 3-2 corresponding to the antenna device 102 of the second preferred embodiment and Model 3 corresponding to the antenna device 101 of the first preferred embodiment to a reader/writer side antenna coil. The simulation conditions are the same or substantially the same as the conditions discussed above with respect to the first preferred embodiment.

As shown in FIG. 9, the coupling coefficient of Model 3-2 is even higher than that of Model 3, due to the configuration of the antenna device 102 of the second preferred embodiment as described above.

While the slit 20S of the planar conductor is provided in a side opposite from the side to which the interlayer connection conductors 13 and 14 are connected in the second preferred embodiment, as shown FIG. 8, operational effects similar to those described above are provided as long as the interlayer connection conductors 13 and 14 do not to cross the slit 20S.

Third Preferred Embodiment

Figure 10:
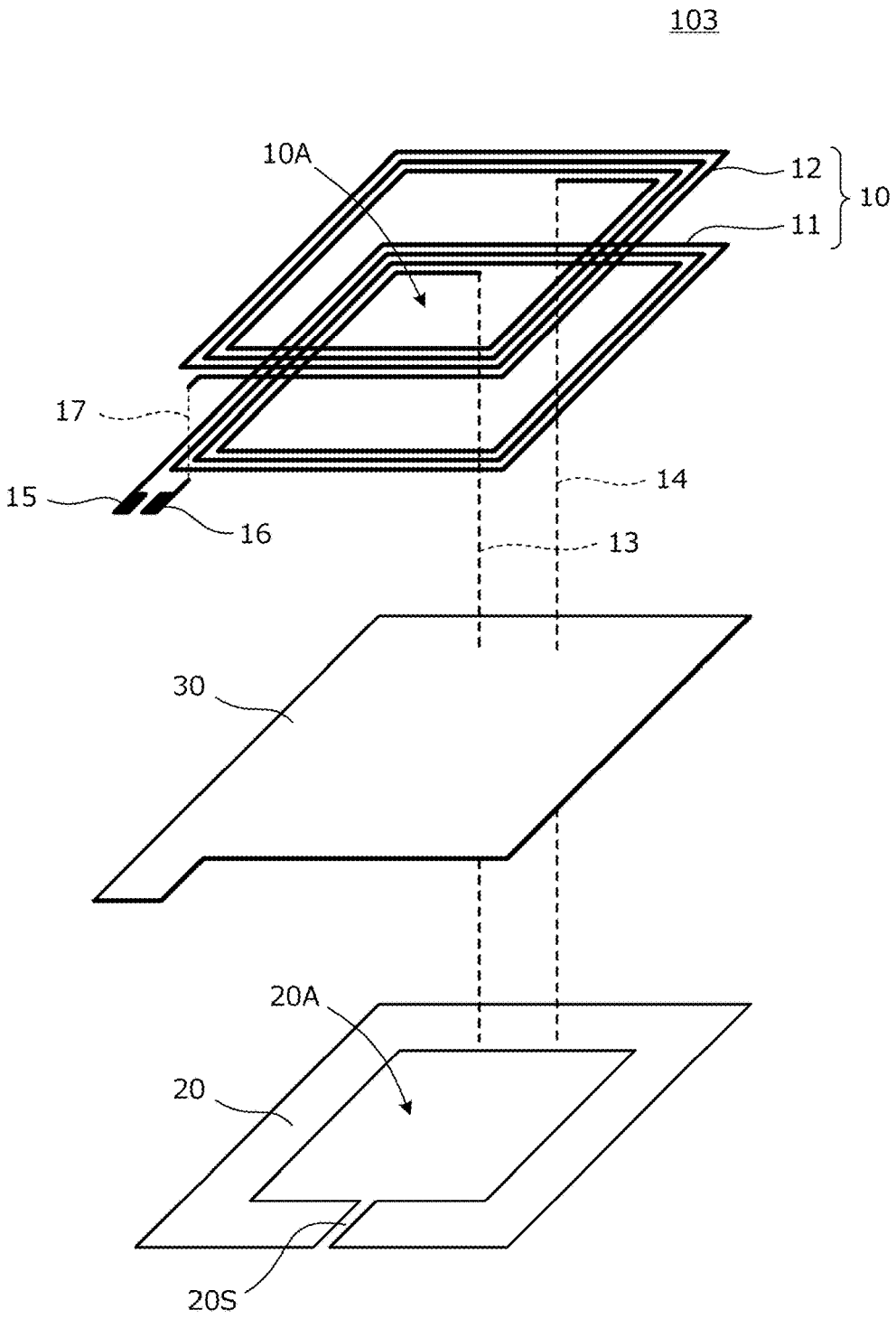
FIG. 10 is an exploded perspective view of an antenna device according to a third preferred embodiment of the present invention.

FIG. 10 is an exploded perspective view of an antenna device 103 according to a third preferred embodiment of the present invention. The antenna device 103 includes a planar coil 10, a planar conductor 20 opposed to the planar coil 10 with an insulating layer 30 interposed therebetween, a first power feed terminal 15, and a second power feed terminal 16. The planar coil 10 includes a first conductor pattern portion 11 and a second conductor pattern portion 12 wound around a coil aperture 10A along a surface of the insulating layer 30.

The antenna device 103 of the third preferred embodiment is different in the structure of the planar coil 10 from the antenna device 101 of the first preferred embodiment and the antenna device 102 of the second preferred embodiment. In the antenna device 103 of the third preferred embodiment, the second conductor pattern portion 12 overlaps with the first conductor pattern portion 11 in plan view.

Since the first conductor pattern portion 11 and the second conductor pattern portion 12 are provided in different layers in the antenna device 103, the outer size of the planar coil 10 is able to be decreased, which provides a reduction in the size of the antenna device.

Fourth Preferred Embodiment

FIGS. 11A, 11B, 12A, and 12B are exploded perspective views of antenna devices according to a fourth preferred embodiment of the present invention. In the antenna devices shown in FIGS. 11A, 11B, 12A, and 12B, magnetic sheets 40, 41, and 42 are added to the antenna device 101 of the first preferred embodiment. For clarity, the insulating layer 30 is not shown in FIGS. 12A and 12B.

Figure 11B:
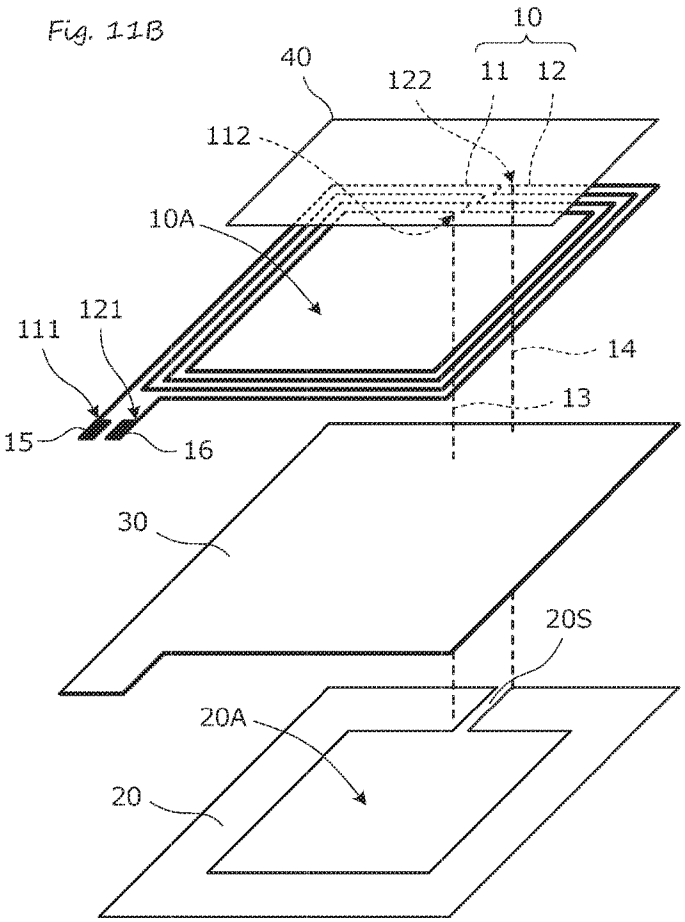
FIGS. 11A and 11B are exploded perspective views of antenna devices according to a fourth preferred embodiment of the present invention.
Figure 11A:
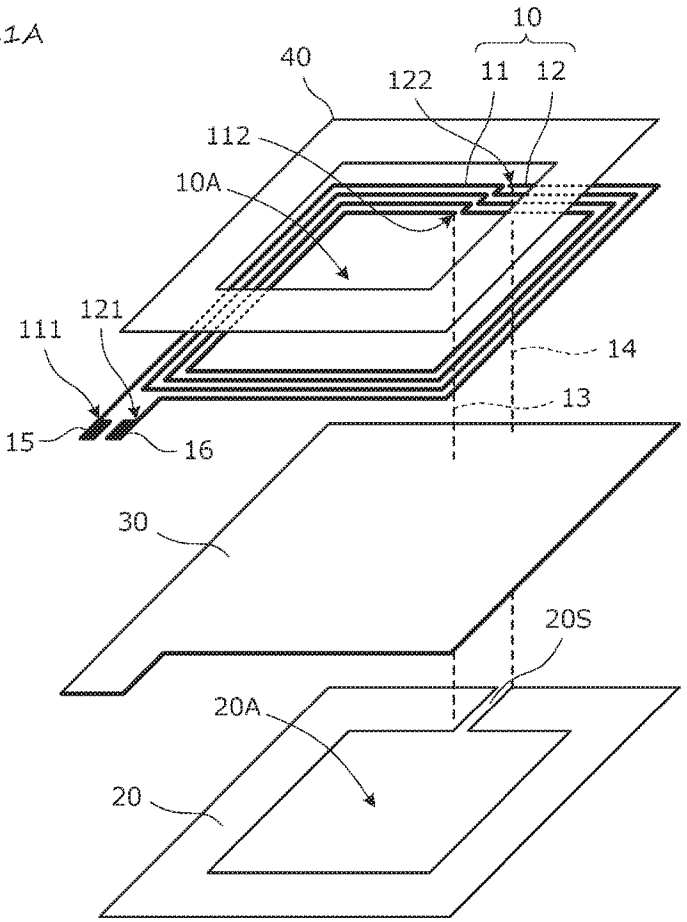

In the antenna device shown in FIG. 11A, a magnetic sheet 40 is superposed on the entire conductor pattern of a planar coil 10. In the antenna device shown in FIG. 11B, a magnetic sheet 40 overlaps with a portion of a conductor pattern of a planar coil 10. Due to the magnetic material covering the planar coil 10, a predetermined large inductance is able to be obtained with a conductive pattern that includes a small number of turns. In other words, since the planar coil is provided by a conductor pattern with a small number of turns, the coil aperture is able to be made relatively large. As a result, the degree of coupling to an antenna on a communication partner side is able to be increased.

When the magnetic sheet 40 is locally attached, as shown in FIG. 11B, the direction of magnetic flux passing through the coil aperture 10A is able to be shifted toward the magnetic sheet 40 by a magnetism collection effect of the magnetic sheet 40. Accordingly, directivity of the antenna device is able to be controlled.

Figure 12B:
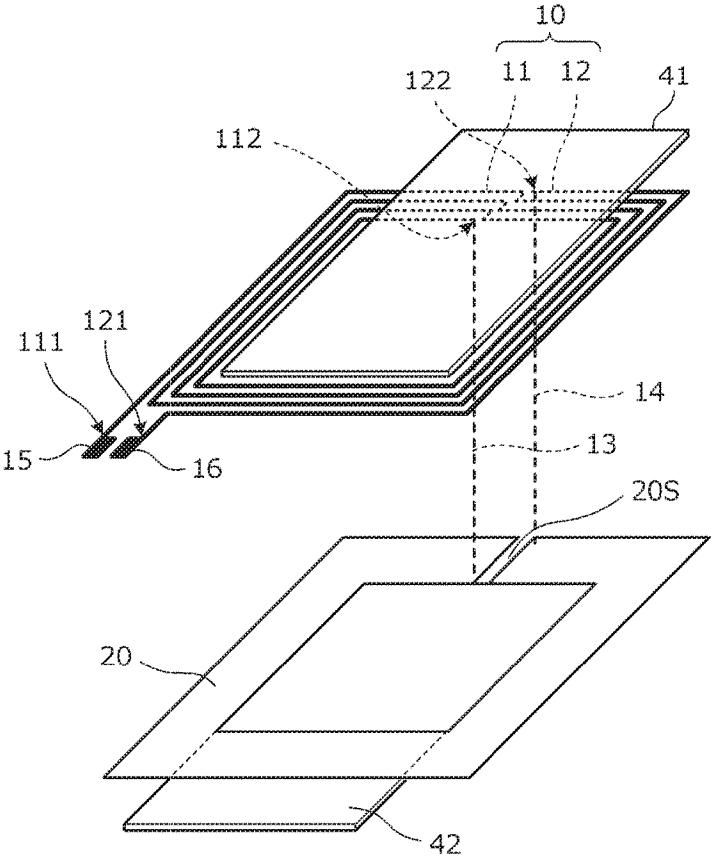
FIGS. 12A and 12B are exploded perspective views of antenna devices according to the fourth preferred embodiment of the present invention.
Figure 12A:
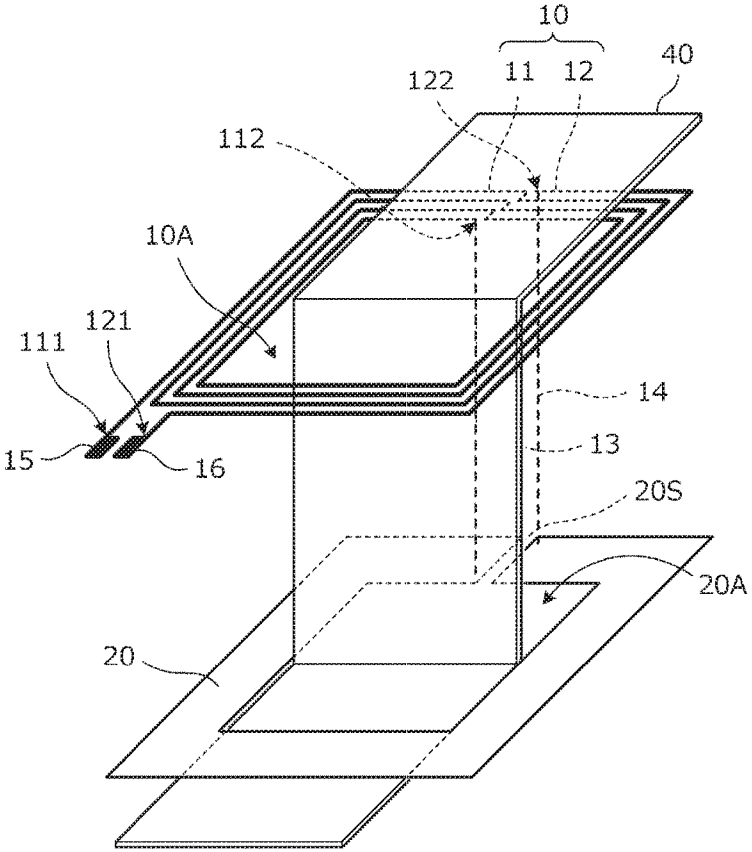

In the antenna device shown in FIG. 12A, a magnetic sheet 40 is located on an upper surface of a first side, of first and second sides of a planar coil 10 that are opposed to each other, and the magnetic sheet 40 is located on a lower surface of the second side of the planar coil 10. In the antenna device shown in FIG. 12B, a magnetic sheet 41 is located on an upper surface of a first side, of first and second sides of a planar coil 10 that are opposed to each other, and a magnetic sheet 42 is located on a lower surface of the second side of the planar coil 10. Due to the magnetic sheets 40, 41, and 42 obliquely passing through the coil aperture of the planar coil, the direction of magnetic flux passing through the coil aperture 10A is able to be shifted toward the magnetic sheet 40 by the magnetism collection effect of the magnetic sheet 40. Accordingly, directivity of the antenna device is able to be controlled.

Besides the operational effects as described above, according to the fourth preferred embodiment, deterioration of the antenna characteristics due to unwanted coupling to peripheral components is able to be reduced. Further, for example, when the antenna device is located adjacent to or in a vicinity of an end portion of a conductor having a large area, such as a ground conductor of a circuit board, an electromagnetic shield conductor provided on a surface of a casing, or a battery pack, the conductor and the antenna device are coupled, and the conductor operates as a radiation member. Hence, effective antenna characteristics are able to be obtained. In particular, when the antenna device is provided with the magnetic sheet, directivity is controlled by the magnetic material and coupling between the antenna device and the conductor is able to be improved.

Fifth Preferred Embodiment

Figure 13:
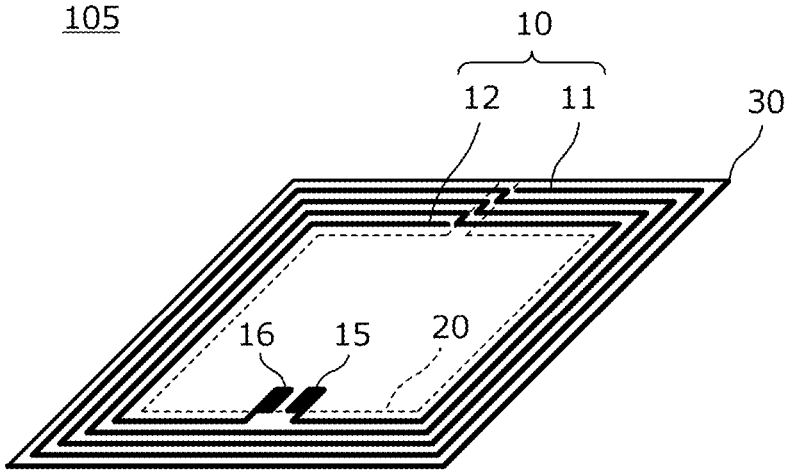
FIG. 13 is a perspective view of an antenna device according to a fifth preferred embodiment of the present invention.
Figure 14:
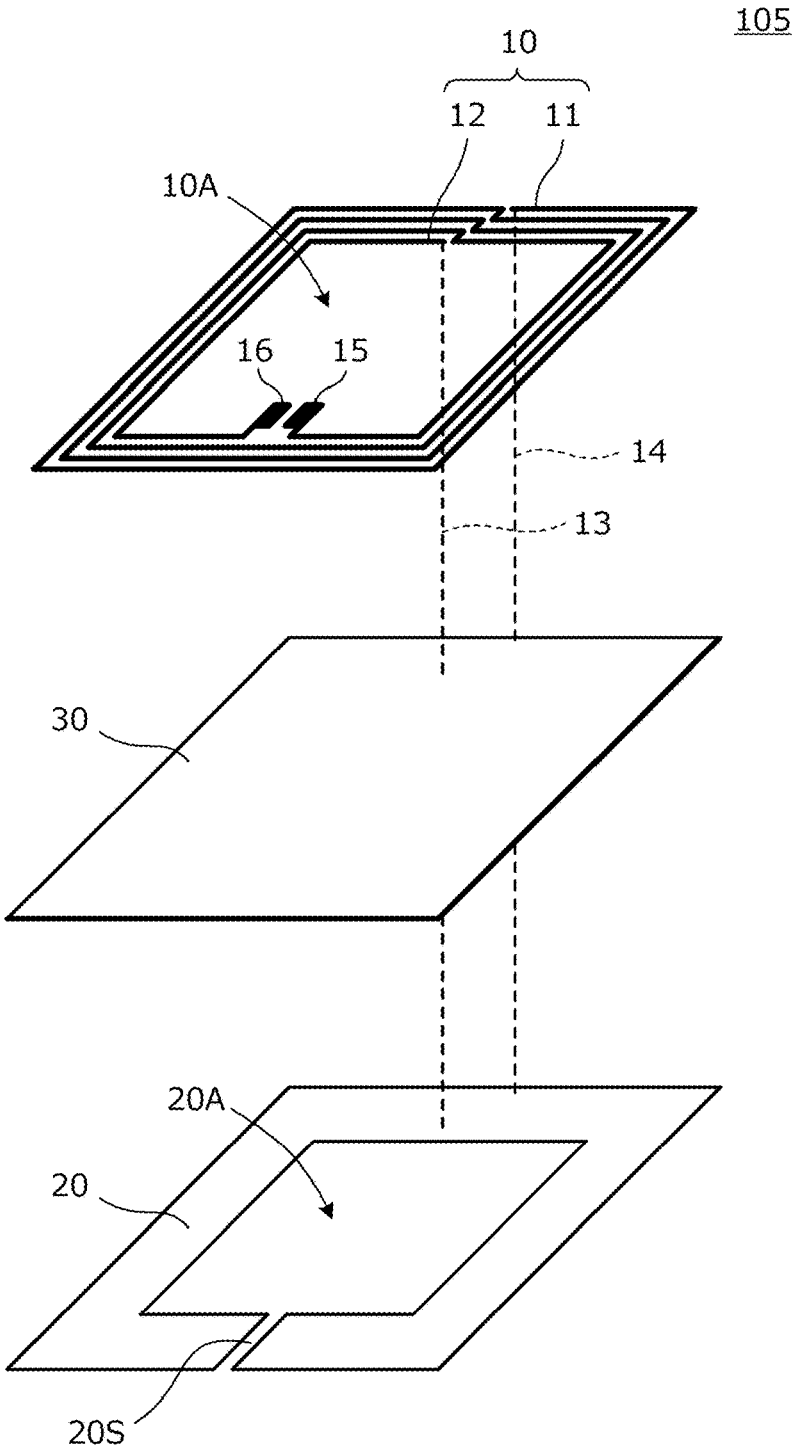
FIG. 14 is an exploded perspective view of the antenna device according to the fifth preferred embodiment of the present invention.

FIG. 13 is a perspective view of an antenna device 105 according to a fifth preferred embodiment of the present invention, and FIG. 14 is an exploded perspective view of the antenna device 105.

The antenna device 105 includes a planar coil 10, a planar conductor 20 opposed to the planar coil 10 with an insulating layer 30 interposed therebetween, a first power feed terminal 15, and a second power feed terminal 16. The planar coil 10 includes a first conductor pattern portion 11 and a second conductor pattern portion 12 wound around a coil aperture 10A along a surface of the insulating layer 30. The planar conductor 20 includes a conductor aperture 20A that overlaps with the coil aperture 10A and a slit 20S that connects a portion of the conductor aperture 20A to an outer edge.

The first conductor pattern portion 11 includes a rectangular or substantially rectangular spiral shape, and the second conductor pattern portion 12 is provided along the inner periphery of the first conductor pattern portion 11. The first power feed terminal 15 is conductively connected to a first end of the first conductor pattern portion 11, and the second power feed terminal 16 is conductively connected to a first end of the second conductor pattern portion 12.

The first power feed terminal 15 and the second power feed terminal 16 are located in an inner side portion of a region including the conductor pattern portions 11 and 12 in plan view.

Accordingly, the first power feed terminal 15 and the second power feed terminal 16 may be located in the inner side portion of the region including the conductor pattern portions 11 and 12 in plan view. Thus, the outer size of the antenna device is able to be reduced.

The positional relationship between the coil aperture 10A of the planar coil 10 and the conductor aperture 20A of the planar conductor 20 is determined and the arrangement positions of the planar coil 10 and the planar conductor 20 are determined such that the conductor aperture 20A overlaps with the coil aperture 10A in plan view in the first through fifth preferred embodiments of the present invention. However, according to a modification of the first through fifth preferred embodiments of the present invention, only a portion of the conductor aperture 20A overlaps with the coil aperture 10A.

Sixth Preferred Embodiment

A sixth preferred embodiment of the present invention is different from the first through fifth preferred embodiments in the shape of a cutout in a planar conductor.

Figure 15:
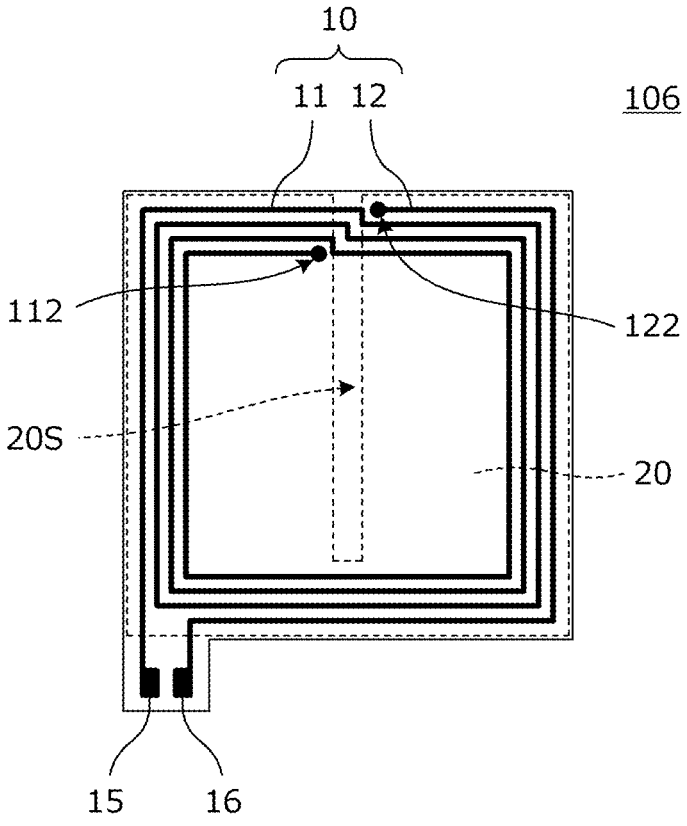
FIG. 15 is a plan view of an antenna device according to a sixth preferred embodiment of the present invention.

FIG. 15 is a plan view of an antenna device 106 according to the sixth preferred embodiment. The antenna device 106 includes a planar coil 10, a planar conductor 20 opposed to the planar coil 10 with an insulating layer interposed therebetween, a first power feed terminal 15, and a second power feed terminal 16. The planar coil 10 includes a first conductor pattern portion 11 and a second conductor pattern portion 12 wound around a coil aperture along a surface of the insulating layer. The planar conductor 20 includes a slit 20S that overlaps with the coil aperture. The first power feed terminal 15 and the second power feed terminal 16 are located in an outer side portion of a region including the conductor pattern portions 11 and 12 in plan view.

The structure of the planar coil 10 is the same or substantially the same as that of the first preferred embodiment. While the antenna device 101 of the first preferred embodiment shown in FIGS. 1 and 2 includes the slit 20S and the conductor aperture 20A, a cutout in the planar conductor 20 may be formed only by the slit 20S in the sixth preferred embodiment. Since the direction of a current flowing on a back surface of the planar conductor 20 is the same as the direction of a current flowing through the planar coil 10, the planar conductor 20 operates as an antenna together with the planar coil 10.

Seventh Preferred Embodiment

A seventh preferred embodiment of the present invention is different from the first through sixth preferred embodiments in the shape of a cutout in a planar conductor.

Figure 16:
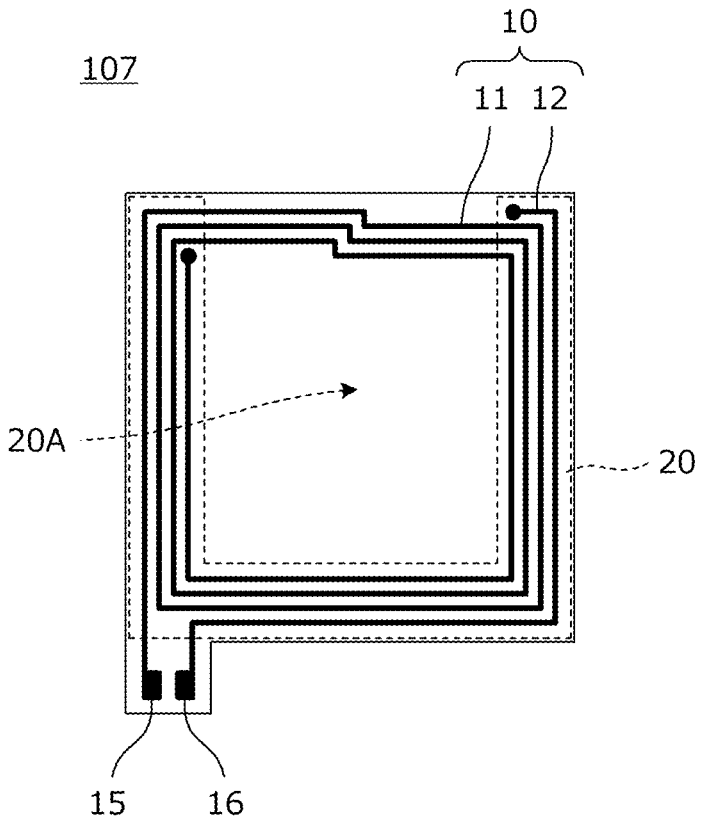
FIG. 16 is a plan view of an antenna device according to a seventh preferred embodiment of the present invention.

FIG. 16 is a plan view of an antenna device 107 according to the seventh preferred embodiment. The antenna device 107 includes a planar coil 10, a planar conductor 20 opposed to the planar coil 10 with an insulating layer interposed therebetween, a first power feed terminal 15, and a second power feed terminal 16. The planar coil 10 includes a first conductor pattern portion 11 and a second conductor pattern portion 12 wound around a coil aperture along a surface of the insulating layer. The planar conductor 20 includes a conductor aperture 20A that overlaps with the coil aperture. The first power feed terminal 15 and the second power feed terminal 16 are located in an outer side portion of a region including the conductor pattern portions 11 and 12 in plan view.

The structure of the planar coil 10 is the same or substantially the same as that of the first preferred embodiment. While the slit 20S and the conductor aperture 20A are provided in the antenna device 101 of the first preferred embodiment shown in FIGS. 1 and 2, a cutout in the planar conductor 20 may be provided only by the conductor aperture 20A as in the seventh preferred embodiment. Since the direction of a current flowing on a back surface of the planar conductor 20 is the same as the direction of a current flowing through the planar coil 10, the planar conductor 20 operates as an antenna together with the planar coil 10.

Eighth Preferred Embodiment

An eighth preferred embodiment of the present invention is different from the first through seventh preferred embodiments in the size of a planar conductor.

Figure 17:
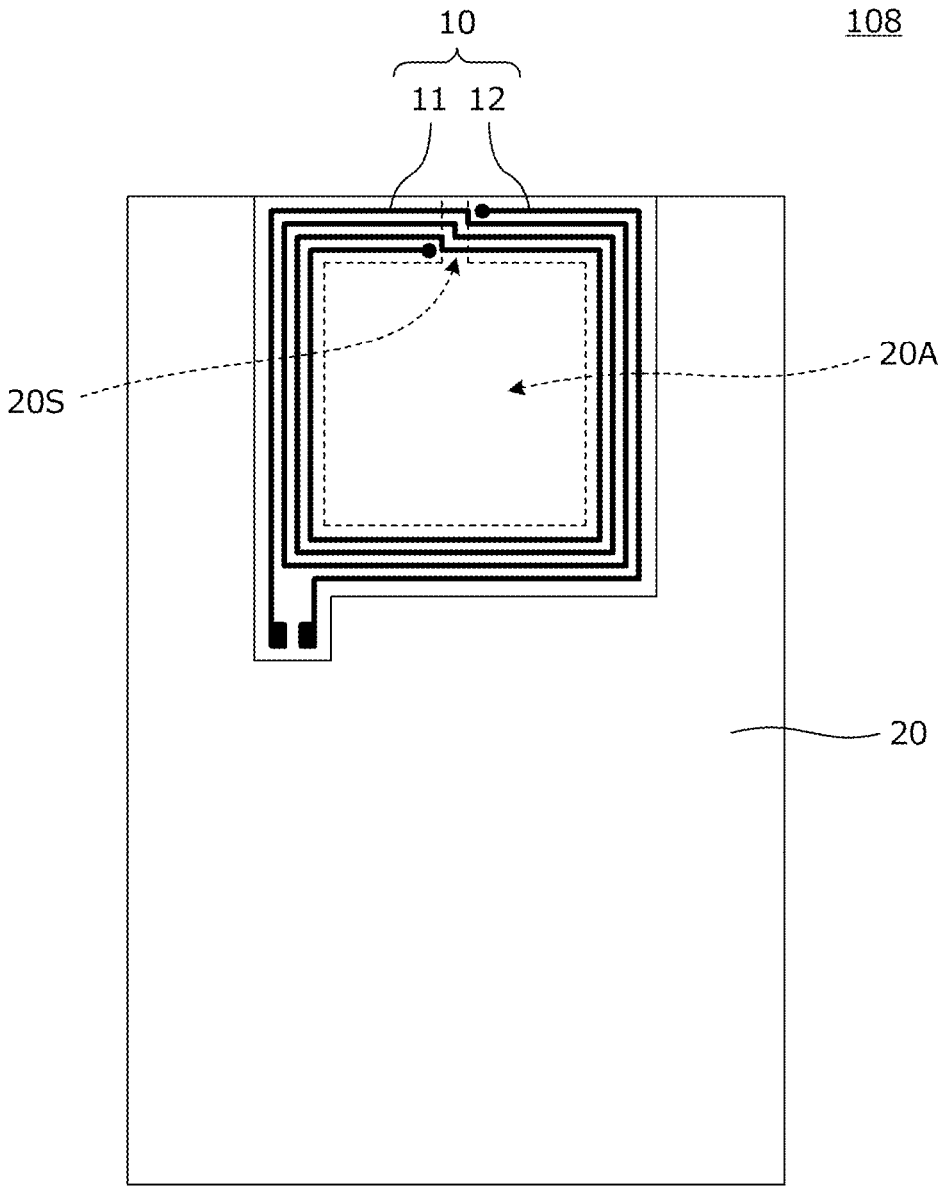
FIG. 17 is a plan view of an antenna device according to an eighth preferred embodiment of the present invention.

FIG. 17 is a plan view of an antenna device 108 according to the eighth preferred embodiment. The antenna device 108 includes a planar coil 10 and a planar conductor 20 opposed to the planar coil 10 with an insulating layer interposed therebetween. The planar coil 10 includes a first conductor pattern portion 11 and a second conductor pattern portion 12. The planar conductor 20 includes a slit 20S and a conductor aperture 20A that overlaps a coil aperture.

It is not necessary for the size of the planar conductor 20 matches the size of the planar coil 10. As shown in the eighth preferred embodiment, the outer size of the planar conductor 20 may be larger than the outer size of the planar coil 10. Because the direction of a current flowing on a back surface of the planar conductor 20 is also the same as the direction of a current flowing through the planar coil 10, the planar conductor 20 operates as an antenna together with the planar coil 10. Further, the current flows to an outer edge of the planar conductor 20, thus spreading magnetic flux.

Ninth Preferred Embodiment

A ninth preferred embodiment of the present invention provides an electronic apparatus 209 including an antenna device 109.

Figure 18:
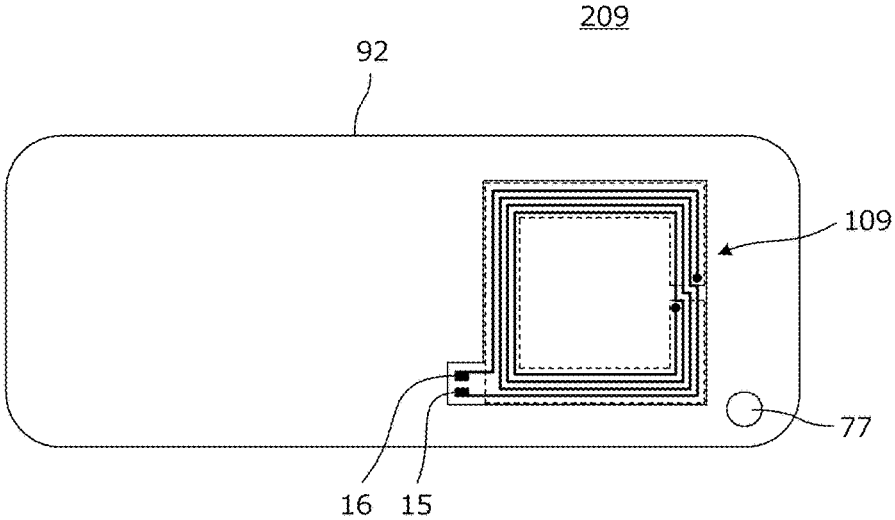
FIG. 18 is an exploded plan view of an electronic apparatus according to a ninth preferred embodiment of the present invention.
Figure 18:
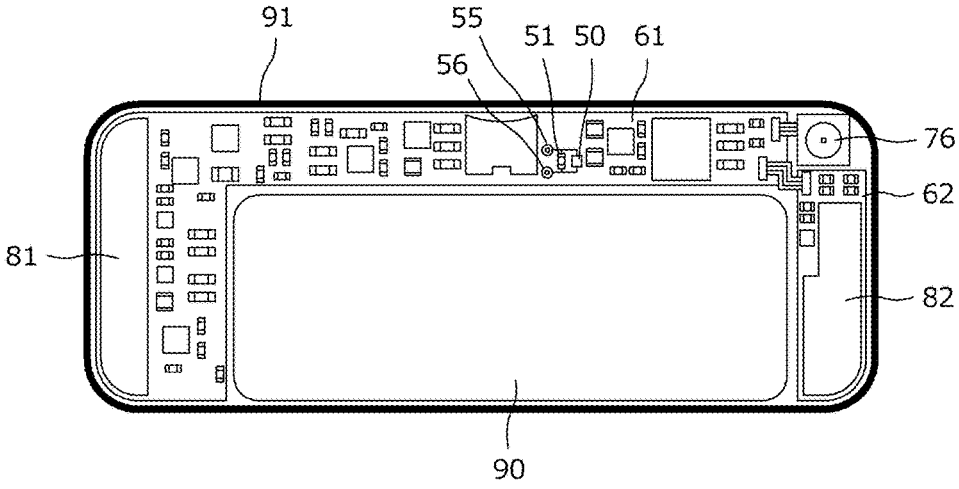

FIG. 18 is an exploded plan view of an electronic apparatus 209. The electronic apparatus 209 may be, for example, a smartphone or similar electronic device. Circuit boards 61 and 62, a battery pack 90, a camera module 76, and the like are stored inside an upper casing 91 of the electronic apparatus 209. On the circuit board 61, an RFIC 50 with a communication circuit, a resonance capacitor 51, and the like are mounted. The circuit board 61 includes with connection conductors 55 and 56 that include, for example, spring pins. On the circuit boards 61 and 62, for example, standing-wave antennas 81 and 82 of a UHF band or an SHF band are provided. The antenna devices 81 and 82 are antennas for, for example, cellular communication, a wireless LAN, Bluetooth (registered trademark), and a GPS. For example, the antenna device 81 operates as a main antenna, and the antenna device 82 operates as a sub-antenna.

A lower casing 92 includes a camera hole 77. The lower casing 92 is a molded body of insulating resin, and an antenna device 109 is attached on an inner surface of the lower casing 92. The antenna device 109 is linearly symmetrical or substantially linearly symmetrical with the antenna device 101 of the first preferred embodiment. The antenna device 109 has the same or substantially the same structure as that of the antenna device 101 of the first preferred embodiment except for the linearly symmetrical shape.

When the upper casing 91 and the lower casing 92 are assembled together, the connection conductors 55 and 56 are electrically connected to power feed terminals 15 and 16 of the antenna device 109 by contact.

Tenth Preferred Embodiment

A tenth preferred embodiment of the present invention provides an electronic apparatus 210 including an antenna device 110.

Figure 19:
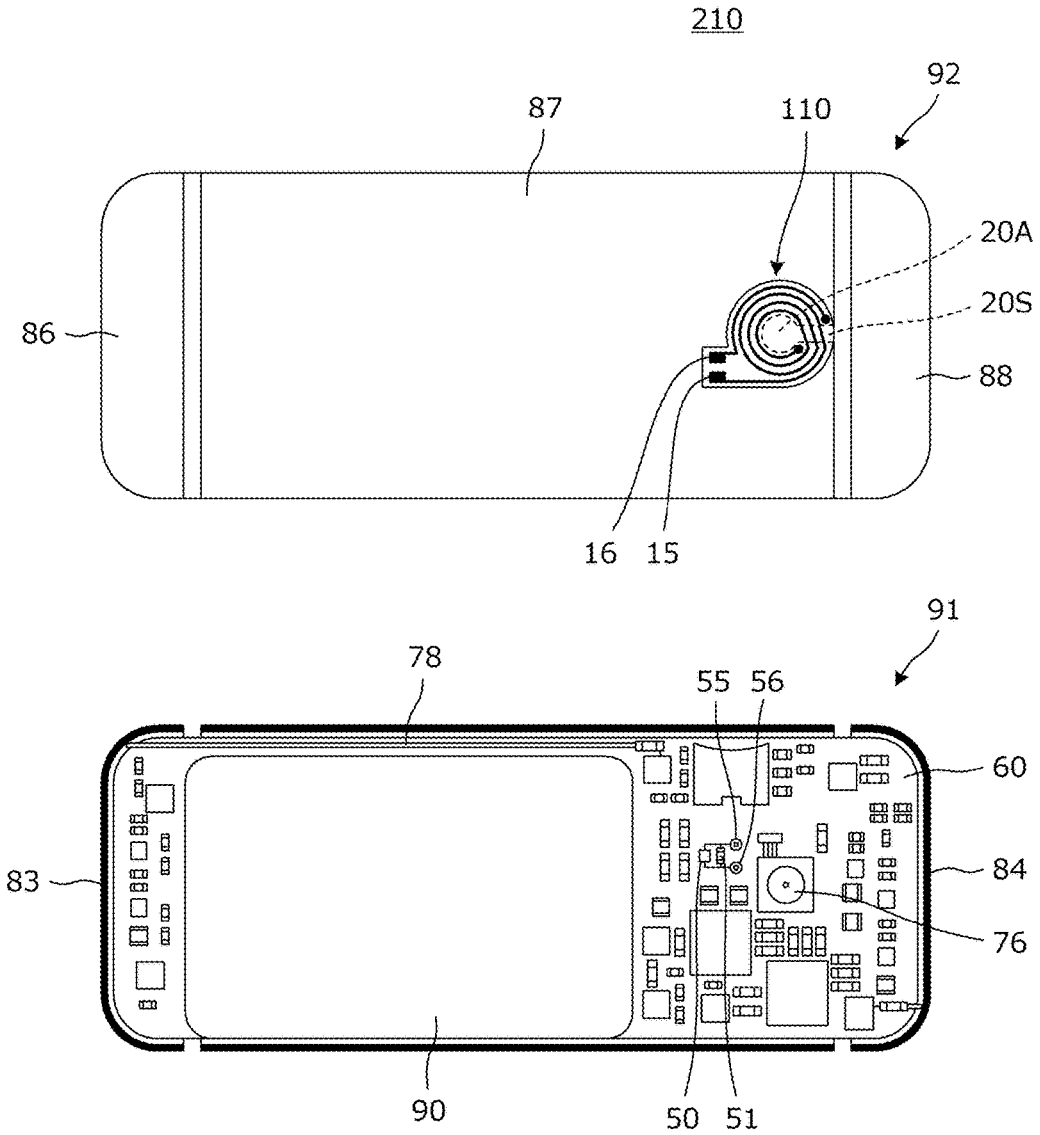
FIG. 19 is an exploded plan view of an electronic apparatus according to a tenth preferred embodiment of the present invention.

FIG. 19 is an exploded plan view of an electronic apparatus 210. The electronic apparatus 210 may be, for example, a smartphone or similar electronic device. A circuit board 60, a battery pack 90, a camera module 76, and the like are stored inside an upper casing 91 of the electronic apparatus 210. On the circuit board 60, an RFIC 50 with a communication circuit, a resonance capacitor 51, and the like are mounted. The circuit board 60 includes connection conductors 55 and 56 that include, for example, spring pins.

The upper casing 91 includes metal portions 83 and 84. The metal portions 83 and 84 of the upper casing 91 are antennas of a UHF band or an SHF band. A first end of a power feed cable 78 is connected to a power feed point of the metal portion 83. A second end of the power feed cable 78 is connected to a power feed circuit. Similarly, in the metal portion 84, a first end of a power feed cable is connected to a power feed point of the metal portion 84, and a second end is connected to a power feed circuit. Antenna devices defined by the metal portions 83 and 84 preferably are antennas for, for example, cellular communication, a wireless LAN, Bluetooth (registered trademark), and a GPS. For example, the metal portion 83 operates as a main antenna and the metal portion 84 operates as a sub-antenna.

A lower casing 92 includes metal portions 86, 87, and 88. The metal portion 87 of the lower casing 92 includes a conductor aperture 20A that also operates as a camera hole, and a slit 20S. An antenna device 110 is attached on an inner surface of the metal portion 87. The antenna device 110 includes the same or substantially the same structure as that of the antenna device 101 of the first preferred embodiment, except that a conductor pattern of a planar coil of the antenna device 110 is a spiral. The antenna device 110 is located so that at least a portion of a coil aperture thereof overlaps with the conductor aperture 20A.

When the upper casing 91 and the lower casing 92 are assembled together, the connection conductors 55 and 56 are electrically connected to power feed terminals 15 and 16 of the antenna device 110 by contact.

The metal portion 87 operates similar to the planar conductor 20 of the eighth preferred embodiment shown in FIG. 17. Thus, the antenna device 110 and the metal portion 87 provide an HF-band antenna. Thus, because the conductor portion of the casing is also able to provide the planar conductor, it is not necessary to include a special exclusive planar conductor, and size and cost are able to be reduced. Further, because the planar conductor is located on an outer surface of the electronic apparatus or at a position adjacent to or in the vicinity of the outer surface, the planar conductor is able to be easily located closer to a communication partner side antenna, and communication performance is able to be easily enhanced.

Modifications to the Preferred Embodiments

While the metal portion of the casing defines and functions as the planar conductor in the tenth preferred embodiment, the planar conductor may be defined by a "conductor portion" made of carbon, graphite, or the like instead of the "metal portion."

For example, the metal portions 83, 84, 86, 87, and 88 are formed by attaching conductor foil to a surface of a resin molded body or by plating the surface with metal, or by metal bodies obtained by shaping or grinding a metal plate. The metal portions 83 and 86 may be integrally formed, and the metal portions 84 and 88 may be integrally formed, for example. Further, the portion operating as the planar conductor may be, for example, a grand pattern of the circuit board or a shield conductor besides the metal portion of the casing.

The conductor aperture 20A may be a hole provided for a device, such as a button, a flash, a speaker, or the like, instead of the camera hole.

While a smartphone is provided as an example in the ninth and tenth preferred embodiments, various preferred embodiments of the present invention are able to be similarly applied to, for example, a cellular phone terminal, a tablet PC, a notebook PC, and a wearable terminal including a wristwatch.

While the outer shapes of the planar conductor and the planar coil are the same or substantially the same rectangular or substantially rectangular shape in the preferred embodiments described above, they may be different from each other. That is, the outer shapes may be non-similar, for example. The planar coil 10 may be defined by a spiral conductor pattern that is round at corner portions or entirely, for example.

While the planar coil and the planar conductor are preferably provided along the flat surface in the preferred embodiments described above, the present invention is not limited thereto. The planar coil and the planar conductor may be partly bent, or may be curved as a whole, for example.

While the planar coil 10 and the planar conductor 20 preferably are insulated by the insulating layer 30 in the preferred embodiments described above, the present invention is not limited thereto. The planar coil 10 and the planar conductor 20 may be simply located apart from each other, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a planar coil including a conductor wound around a coil aperture, the planar coil having a planar or a substantially planar shape;

a planar conductor opposed to the planar coil and including a cutout that at least partially overlaps with the coil aperture; and a first power feed terminal and a second power feed terminal located in an outer side portion of a region including the planar coil or an inner side portion of the coil aperture in plan view; wherein the planar coil includes a first conductor pattern portion and a second conductor pattern portion that extend along an outer periphery or an inner periphery of the first conductor pattern portion or that overlap with the first conductor pattern portion in plan view;

the first power feed terminal is conductively connected to a first end of the first conductor pattern portion, and the second power feed terminal is conductively connected to a first end of the second conductor pattern portion on a side adjacent to or in a vicinity of the first end of the first conductor pattern portion; and second ends of the first conductor pattern portion and the second conductor pattern portion are connected to the planar conductor.

2. The antenna device according to claim 1, wherein:

the cutout includes a conductor aperture and a slit that connects a portion of the conductor aperture to an outer edge of the planar conductor; and the conductor aperture at least partially overlaps with the coil aperture.

3. The antenna device according to claim 2, wherein the second ends of the first conductor pattern portion and the second conductor pattern portion are connected to the planar conductor and do not cross the slit.

4. The antenna device according to claim 2, wherein the second ends of the first conductor pattern portion and the second conductor pattern portion are connected to the planar conductor and cross the slit.

5. The antenna device according to claim 1, wherein the planar coil is wound around the coil aperture in a plurality of turns.

6. The antenna device according to claim 1, wherein a magnetic sheet covers at least a portion of the planar coil.

7. The antenna device according to claim 6, wherein the magnetic sheet is superposed on the entire conductor pattern of the planar coil.

8. The antenna device according to claim 6, wherein the magnetic sheet passes through the coil aperture of the planar coil.

9. The antenna device according to claim 8, wherein the magnetic sheet obliquely passes through the coil aperture of the planar coil.

10. The antenna device according to claim 6, wherein the magnetic sheet controls directivity of the antenna device.

11. The antenna device according to claim 1, wherein an outer size of the planar conductor is larger than an outer size of the planar coil.

12. The antenna device according to claim 1, wherein a direction of current flow in the planar coil is opposite to a direction of current flow in the planar conductor.

13. An electronic apparatus comprising:

an antenna device; and a casing; wherein the antenna device includes:

a planar coil including a conductor wound around a coil aperture, the planar coil having a planar or a substantially planar shape;

a planar conductor opposed to the planar coil and including a cutout that at least partially overlaps with the coil aperture; and a first power feed terminal and a second power feed terminal located in an outer side portion of a region including the planar coil or an inner side portion of the coil aperture in plan view;

the planar coil includes a first conductor pattern portion and a second conductor pattern portion that extend along an outer periphery or an inner periphery of the first conductor pattern portion or that overlap with the first conductor pattern portion in plan view;

the first power feed terminal is conductively connected to a first end of the first conductor pattern portion, and the second power feed terminal is conductively connected to a first end of the second conductor pattern portion on a side adjacent to or in a vicinity of the first end of the first conductor pattern portion; and second ends of the first conductor pattern portion and the second conductor pattern portion are connected to the planar conductor.

14. The electronic apparatus according to claim 13, wherein the casing includes a conductor portion, and the conductor portion defines the planar conductor.

15. The electronic apparatus according to claim 13, wherein the lower casing includes a camera hole.

16. The electronic apparatus according to claim 15, wherein:

the cutout includes a conductor aperture and a slit that connects a portion of the conductor aperture to an outer edge of the planar conductor;

the conductor aperture at least partially overlaps with the coil aperture; and the conductor aperture is defined by the camera hole.

* * * * *